United States Patent [19]

Herold

[11] 4,375,282

[45] Mar. 1, 1983

[54] CORE CONFIGURATION FOR CASTING HOLLOW PARTS IN MATING HALVES

[75] Inventor: Robert A. Herold, Tolland, Conn.

[73] Assignee: United Technologies Corporation, Hartford, Conn.

[21] Appl. No.: 164,630

[22] Filed: Jun. 30, 1980

[51] Int. Cl.[3] ..... B22C 9/10

[52] U.S. Cl. ..... 249/175; 164/361; 164/365; 164/369

[58] Field of Search ..... 164/6, 15, 19–21, 164/24, 27, 28, 47, 137, 235, 247, 369, 365, 361, 516–519; 249/142, 175

[56] References Cited

U.S. PATENT DOCUMENTS 3,965,963 6/1976 Phipps et al. ..... 164/365
3,981,344 9/1976 Hayes et al. ..... 164/516
4,068,702 1/1978 Herold ..... 164/235 X
4,078,598 3/1978 Kelso et al. ..... 164/235 X

FOREIGN PATENT DOCUMENTS 48-30206 9/1973 Japan ..... 164/27

*Primary Examiner*—Gus T. Hampilos
*Attorney, Agent, or Firm*—C. G. Nessler

[57] ABSTRACT

Disclosed is a core for producing halves of cambered hollow articles, such as bonded turbine blades. The core has opposing flanges which differ in thickness, since the opposing contour surfaces are rotated relative to one another, compared to the relationship of the contour surfaces in the interior of the hollow article being produced. Thus, the core is made thicker and more sound in the area of high camber where it is otherwise prone to be thin.

1 Claim, 4 Drawing Figures

CORE CONFIGURATION FOR CASTING HOLLOW PARTS IN MATING HALVES

DESCRIPTION

Background Art

1. The invention relates to ceramic cores for metal casting, particularly those usable in the casting of superalloy gas turbine airfoils.

2. Recently, techniques have been developed and published in patents and elsewhere regarding processes for making gas turbine vanes and blades from bonded opposed halves. As disclosed in Hayes et al, U.S. Pat. No. 3,981,344 and Phipps et al, U.S. Pat. No. 3,965,963, the opposed halves are most suitably cast on opposite sides of a flanged "strongback" or central ceramic core. As reference to the aforementioned patents will show, the airfoils previously cast did not have a very high degree of camber. Thus, the flanged core was similar in configuration to a conventional core (usable in casting a unitary hollow object) except that the opposing sides were displaced from one another along a plane perpendicular to the plane of the flanges, with the amount of displacement being equal to the flange width.

Cores made in such fashion are satisfactory for airfoils with relatively low camber, but new problems are presented when making airfoils with high camber by the bonded blade halve approach. As is indicated in more detail in the following description of the preferred embodiment, the higher camber combined with the method of flanged core construction of the past results in a core which has a substantial variation in thickness, thereby introducing problems in core fabrication and structural stability. Cores with sharply varying cross sections can have varying shrinkage and drying rates associated with their different thickness which may result in unwanted warpage. Therefore, there is a need for an improved technique and design of central core for casting cambered blade halves.

DISCLOSURE OF INVENTION

An object of the invention is to provide a cambered core for forming mating parts of a hollow object, where the core has improved structural stability and more resistance to warpage and other deformation.

In accord with the invention, an improved core has two opposing surfaces which are rotated, with respect to the positions which the opposing surfaces cast thereagainst have in a hollow article. The rotation of the opposing surfaces, compared to the simple lateral displacement of the prior art, provides the area of highest camber with increased thickness, strength, and soundness. The core is made more nearly uniform in thickness. In the preferred embodiment the core has longitudinal flanges at the extremes of the opposing surfaces, with one flange being thicker than the other. Thus, when parts are cast in a mold using an inventive core the parts will be both spaced apart and rotated compared to the position they may assume upon being removed from the mold and mated to form the hollow article.

In practice of the invention greater accuracy is achieved in parts cast against the cores which are more stable, as the improved design causes less variation from shrinkage during forming and deflection during casting.

BEST MODE FOR CARRYING OUT THE INVENTION

The preferred embodiment is described in terms of a gas turbine airfoil, but it will be apparent that the invention is equally useful for casting other analogous shapes where the same problems are presented. The aforementioned U.S. Pat. Nos. 3,965,963 and 3,981,344 are hereby incorporated by reference, as they show the general technology of making blade halves with cores in which the present invention will be useful.

Figure 1:
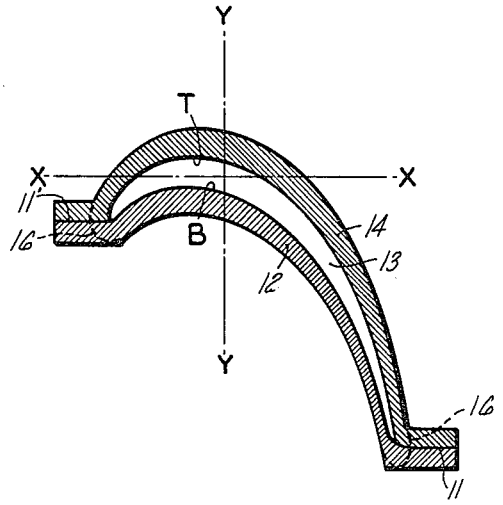
FIG. 1 shows a cross section of two opposing metal blade halves mated to form a hollow gas turbine airfoil.

FIG. 1 shows one cross section of two higher camber airfoil halves in their mated position; these halves are sought to be fabricated using the inventive core. The concave half 12 and the convex half 14 mate at flange contact points 11 and 11' to form a hollow object having an interior cross section space 13. (After bonding at the flange points the final airfoil shape will be formed by machining away the flanges generally along the dotted contour lines 16.) The cross-sectional space 13, which will typically vary along the length of an airfoil, is thus defined by the contour surface T on the inner surface of the convex airfoil half 14 and the contour surface B on the inner surface of the concave half 12. The space has been fitted with x and y axes which will be referred to below to illustrate the changed relative positions of B and T contours in the cores from which blade halves are formed.

Figure 2:
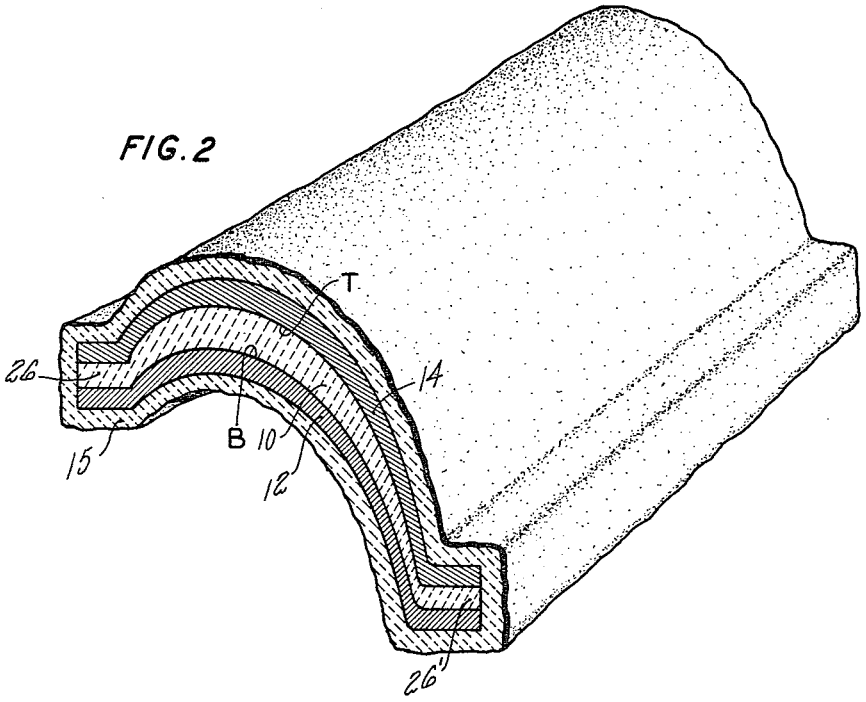
FIG. 2 shows the use of a flanged central core to form opposing blade halves by casting in a ceramic mold.

FIG. 2 illustrates in segmental section how the blade halves 12 and 14 are typically formed by casting metal into a ceramic mold 15 containing a central core 10 and illustrates the longitudinal nature of the flanges 26–26'. The central core, made of ceramic material, is held within the ceramic mold in a suitable position to produce the halves. Thus the ceramic core has the surface contours B and T which are desired in the blade halves (with due allowance for metal shrinkage, of which those familiar with the art are well aware). It will be further noted that the techniques used heretofore result in the opposing longitudinal flanged faces of the blade halves being substantially parallel.

Figure 3:
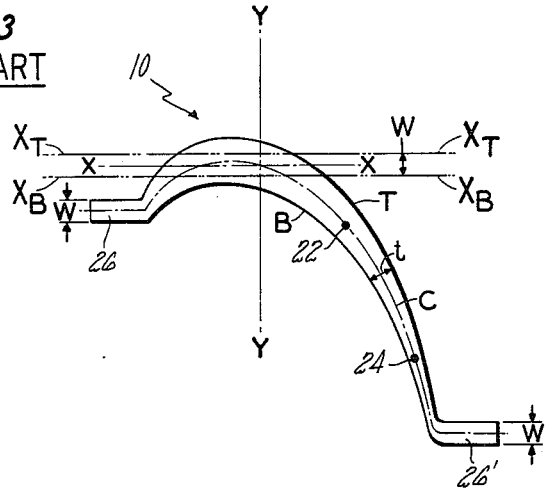
FIG. 3 PRIOR ART
FIG. 3 shows a core of the prior art with varying thickness.

FIG. 3 illustrates in cross section the typical shape of a high camber central core 10 made according to the teachings of the prior art. Referring to FIG. 1 in combination with FIG. 3, it is seen that the cross section of core 10 in FIG. 3 is defined by the surfaces T and B which are, compared to their relative positions in the cavity sought in the hollow airfoil, displaced along the y axis an additional distance w apart from each other. This displacement is illustrated in that the y axes of the B and T contours are coincident while the $x_B$ axis (of contour B) is displaced distance w from the $x_T$ axis (of contour T). This displacement desirably allows the creation of the leading edge flange 26 and 26', also of thickness w, and provide increased thickness and structural soundness of the core throughout. A more sound and deflection resistant core is one of the benefits obtainable with the split airfoil approach. However, it will be noted that the core thickness t varies substantially along the airfoil camber, as for instance between points 22 and 24 in the trailing edge portion of the airfoil. Thickness t as defined herein is the dimension of the core measured perpendicular to the core's imaginary center line contour, C, which also serves as a measure of the core's camber. It will be observable from FIG. 3 that the greater the camber of the airfoil contour C, the greater will be the variation in the airfoil thickness t between points such as 22 and 24. It is this variation in thickness which can cause problems of uneven consolidation and shrinkage during fabrication of the molded ceramic core, thereby resulting in warpage and other dimensional deviations which must be overcome.

Figure 4:
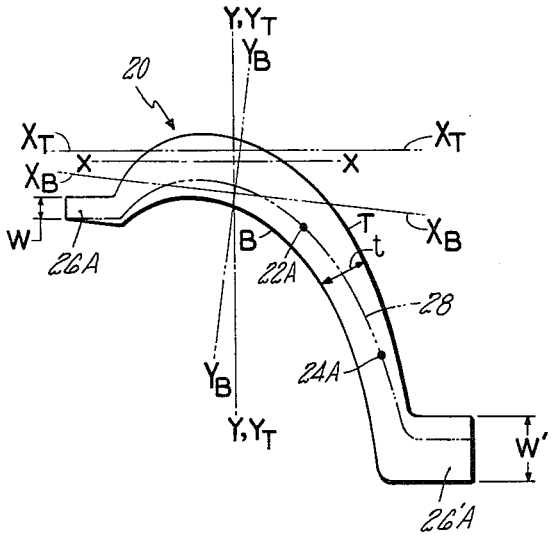
FIG. 4 shows a core of the present invention.

FIG. 4 shows a cross section of a core of the present invention. Surfaces B and T are displaced apart along the y axis a minimum distance w as before, but now the x and y axes of the surface contour B and T have been relatively rotated. To illustrate this, the location of the contour B as it was in the prior art embodiment of FIG. 3 is shown in phantom by line 28. Thus it will be seen that the flange 26A is about the same as flange 26 in FIG. 3 while the trailing edge flange 26'A is increased in thickness. But most notably the relative disposition of B and T has been such that the core thickness t has been increased in the trailing edge, as in the region between points 22*a* and 24*a*, to create a more uniform thickness.

The new position of the contour surface B in space is illustrated by the movement of the axes $(x—x)_B$ and $(y—y)_B$ compared to the position of axes $(x—x)_T$ and $(y—y)_T$ which serve to define the relative locations of the contour surfaces. Of course, alternative rotation of the opposing contour surface T with respect to the datum position, or other combination of relative movements of the contours B and T may accomplish the object of establishment of a more nearly uniform thickness t.

Generally, an improved core has a more uniform thickness owing to the rotation of the opposing surface contours B and T from their relative positions in space at which they define the opposing contours in an airfoil interior space. Generally the thickness of the smaller flange (leading edge flange 26A in FIG. 4) must not be below a dimension necessary for strength and stability. It is not desirable to increase the thickness of the now-thicker flange (trailing edge flange 26'A) to a much greater amount than the contiguous camber section, and thus this aspect together with the inherent limitations of the particular B and T contours will not necessarily permit attainment of the ideal uniformity of thickness. Nonetheless, to the extent that the thickness of the core is made more nearly uniform, better core dimensioning and stability will result.

More simply, it may be said that the flange at the thinner trailing edge end of the airfoil core has been increased compared to the flange at the thicker leading edge of the core. Thus an inventive flanged core has one flange thicker than another. Referring back now to FIG. 2, it should be appreciated that the use of such a core will result in there being relative rotation of the mating metal blade halves during casting, as measured by previously parallel opposing flanges.

Of course, in the Figures described above only one cross section of the airfoil cavity was shown, whereas the typical airfoil has a length along which the camber and cross section space will typically vary substantially. Thus the degree to which the rotation of the opposing contours is effected may vary from one point to the other along the length of the airfoil and for the entirety of the core a compromise or intermediary rotation and displacement may be chosen to best achieve the object of relatively uniform thickness both along the camber and length of the airfoil.

The invention has been shown in terms of a core having flanges, as is most suited for making split blade halves which are to be joined by bonding. However, the invention will be also useful for the fabrication of halves of components such as airfoils where flanges are not desired.

Although this invention has been shown and described with respect to a preferred embodiment thereof, it should be understood by those skilled in the art that various changes and omissions in the form and detail thereof may be made therein without departing from the spirit and scope of the invention.

What is claimed is:

1. A flanged airfoil core for use in casting the mating halves of a hollow airfoil article having a cambered interior space of varying dimension defined by opposing contour surfaces of the halves; the airfoil core having a length and orthogonal x and y axes perpendicular thereto;

a camber shape cross section taken in the x-y axis plane normal to the length;

two longitudinal integral flanges, spaced apart along the x axis of the cross section and running along the length of the core at opposing lengthwise edges thereof, one of the flanges having a thickness substantially greater than the thickness of the other flange, as the thickness is measured in the y axis direction;

a first side and a second opposed side, each consisting of a contoured surface, the sides defining the camber cross section shape along the length of the core, each of said surfaces terminating at the opposing lengthwise edges where the integral flanges are located; and a generally uniform thickness along the camber shape cross section as compared to a core having identically shaped contoured surfaces and uniform thickness flanges arranged along longitudinal edges of the core with the identically shaped contoured surfaces.

* * * * *